US006068052A

United States Patent [19]

Dobbs

[11] Patent Number: 6,068,052

[45] Date of Patent: May 30, 2000

[54] NO TAP TOOL FOR DOWNHOLE RECIPROCATING PUMPS

[76] Inventor: Jerry W. Dobbs, 1600 E. 166 St. N., Skiatook, Okla. 74070

[21] Appl. No.: 09/061,391

[22] Filed: Apr. 16, 1998

[51] Int. Cl.[7] ..... E21B 43/00; F04B 21/04

[52] U.S. Cl. ..... 166/105.2; 166/68; 417/545

[58] Field of Search ..... 166/241.2, 105.2, 166/109, 68, 69, 241.3; 417/545, 547, 548, 550

[56] References Cited

U.S. PATENT DOCUMENTS

| | | | |
|---|---|---|---|
| 3,021,794 | 2/1962 | Knox | 417/454 |
| 3,376,826 | 4/1968 | Crowe | 417/554 |
| 3,598,206 | 8/1971 | Hennells | 188/287 |
| 4,571,162 | 2/1986 | Knox | 417/554 |
| 4,621,693 | 11/1986 | Caldwell et al. | 166/311 |
| 4,963,078 | 10/1990 | Agee | 417/545 |
| 5,236,038 | 8/1993 | Clemishire | 166/178 |

OTHER PUBLICATIONS

Brown et al, The Technology of Artificail Lift Methods, pp10–16, , Production Publishing Co., 1977.

*Primary Examiner*—Frank Tsay
*Attorney, Agent, or Firm*—Frank J. Catalano

[57] ABSTRACT

A tool which eliminates the need for "tapping" in downhole reciprocating pump applications is connectable between the last sucker rod of a sucker rod string and the downhole pump. The tool has a cylinder with a closed end and an internal annular seat proximate an open end houses a piston whch reciprocates slidably within the cylinder and is free to rotate within the cylinder. The travel of the piston is limited in one direction by the closed end of the cylinder and in the opposite direction by the seat. The closed end of the cylinder is externally adapted for connection of the tool between the last sucker rod of the sucker rod string and the pump and the piston has a portion extending through the open end of the cylinder which is also adapted for connection of the tool between the last sucker rod of the sucker rod string and the pump. At least one aperture is provided through a closed end side wall of the cylinder and through an open end side wall of the cylinder so that well fluid can be vented from the cylinder as the piston reciprocates.

11 Claims, 3 Drawing Sheets

NO TAP TOOL FOR DOWNHOLE RECIPROCATING PUMPS

BACKGROUND OF THE INVENTION

This invention relates generally to equipment used in producing fluid from a well and more particularly concerns tools to enhance the operation of downhole reciprocating pumps.

In downhole reciprocating pump applications, it is generally recommended that the pump plunger stroke not permit the plunger to strike or bump the pump at the bottom of its stroke. Bumping is undesirable because, if the plunger does make contact with the pump, the impact is transmitted to the pump, to the sucker rod string components and to the gear box at the surface, increasing the possibility of damage to all of these components.

However, if bumping is avoided, the plunger often becomes stuck due to clogging, obstructions or debris within the pump. This can result in reduced efficiency in the pumping process and even in down time to clear the clogging, obstruction or debris. It also can cause damage to the pump components.

In order to achieve continuous and efficient pumping while minimizing the risk of damage to the pumping system components, "tapping" has become a very common practice in the industry. "Tapping" is the coordination of the length of the plunger with the available stroke length in the pump so that, at its maximum downstroke, the plunger "taps" rather than "bumps" the pump to release the plunger. While this practice reduces the impact on the pump, it also is not recommended. It is very difficult to establish a suitable "tapping" stroke. When the pump is idle for a period of time, the gas contained in the fluid column has time to release. Therefore, the fluid column is heavier than during normal operation. Consequently, the sucker rod string stretches. Generally, several stroke adjustments are required in order to achieve a suitable "tapping" stroke. Even then, the desired end result is still the impact of the plunger with the pump and the possibility of damage, though reduced, is still great.

In a different approach to the problem, U.S. Pat. No. 5,236,038 issued to Steve Clemshier on Aug. 17, 1993, teaches a pump shaker which is connected in the rod string near the downhole pump. The shaker shakes the pump on every stroke of the rod string in order to free a stuck plunger. However, the shaker permits no relative rotational motion of its components and the plunger, which is connected to the shaker, cannot rotate in relation to the rod string. Thus, the full vertical force applied by the shaker on every stroke is unidirectionally exerted on the plunger and maximum stretching and compression of the plunger occurs on every stroke.

It is, therefore, an object of this invention to provide a tool which eliminates the need for "tapping" in the operation of a downhole pump. Another object of this invention is to provide a tool which reduces the unidirectional application of force to the plunger of a downhole pump. A further object of this invention is to provide a tool that allows the plunger of a downhole pump to take the path of least resistance to overcome a stuck condition.

SUMMARY OF THE INVENTION

In accordance with the invention, a tool connectable between the last sucker rod of a sucker rod string and a downhole pump is provided in which a cylinder with a closed end and an internal annular seat proximate an open end houses a piston which reciprocates slidably within the cylinder and is free to rotate within the cylinder. The travel of the piston is limited in one direction by the closed end of the cylinder and in the opposite direction by the seat. The closed end of the cylinder is externally adapted for connection of the tool between the last sucker rod of the sucker rod string and the pump and the piston has a portion extending through the open end of the cylinder which is also adapted for connection of the tool between the last sucker rod of the sucker rod string and the pump. At least one aperture is provided through a closed end side wall of the cylinder and through an open end side wall of the cylinder so that well fluid can be vented from the cylinder as the piston reciprocates.

In a preferred embodiment of the device, the cylinder is concentric about a vertical longitudinal axis and has an internally threaded upper portion, a smooth middle portion and a lower portion of inner diameter less than the inner diameter of the middle portion so as to form the annular seat at the junction of the middle and lower portions of the cylinder. The upper portion of the cylinder is internally threaded. The plunger, which is also concentric about the vertical longitudinal axis, has an externally threaded lower portion, a smooth middle portion, a smooth upper portion and an upper horizontal end face. The plunger upper portion has an outer diameter greater than the outer diameter of the plunger middle portion so as to form an annular stop at the junction of the plunger middle and upper portions. The upper portion of the plunger reciprocally slides within the cylinder middle portion and the stop of the plunger and the seat of the cylinder are cooperable to limit the lowermost travel of the plunger upper portion within the cylinder. The pin, which is also concentric about the vertical longitudinal axis, has an externally threaded lower portion with a horizontal end face. The pin lower portion is engaged in the internally threaded upper portion of the cylinder. The pin has a middle portion of outer diameter greater than the inner diameter of the plunger so as to position the lower end face of the pin at the top of the middle portion of the cylinder when the lower portion of the pin is fully threaded into the cylinder. The pin also has an externally threaded upper portion which is adapted for engagement of the tool with the last sucker rod of the sucker rod string. The pin and plunger end faces are cooperable to limit the uppermost travel of the plunger upper portion within the cylinder with the plunger lower portion extending below the cylinder lower portion. Preferably, four apertures are substantially equally spaced about the circumference of the cylinder, one set of apertures being substantially immediately below the pin face and the other set being substantially immediately above the cylinder seat.

As a result of this configuration, the piston or plunger strikes the cylinder at the upper and lower ends of every stroke but the plunger does not make contact with the pump at the bottom of its stroke. Thus, minimal impact is experienced by the other system components. Furthermore, since the tool components are concentric about the longitudinal axis of the tool, the tool components are independently free to rotate about the tool axis, allowing the plunger of the pump to rotate to the path of least resistance to achieve its freedom, thereby further reducing the forces exerted on the system components.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
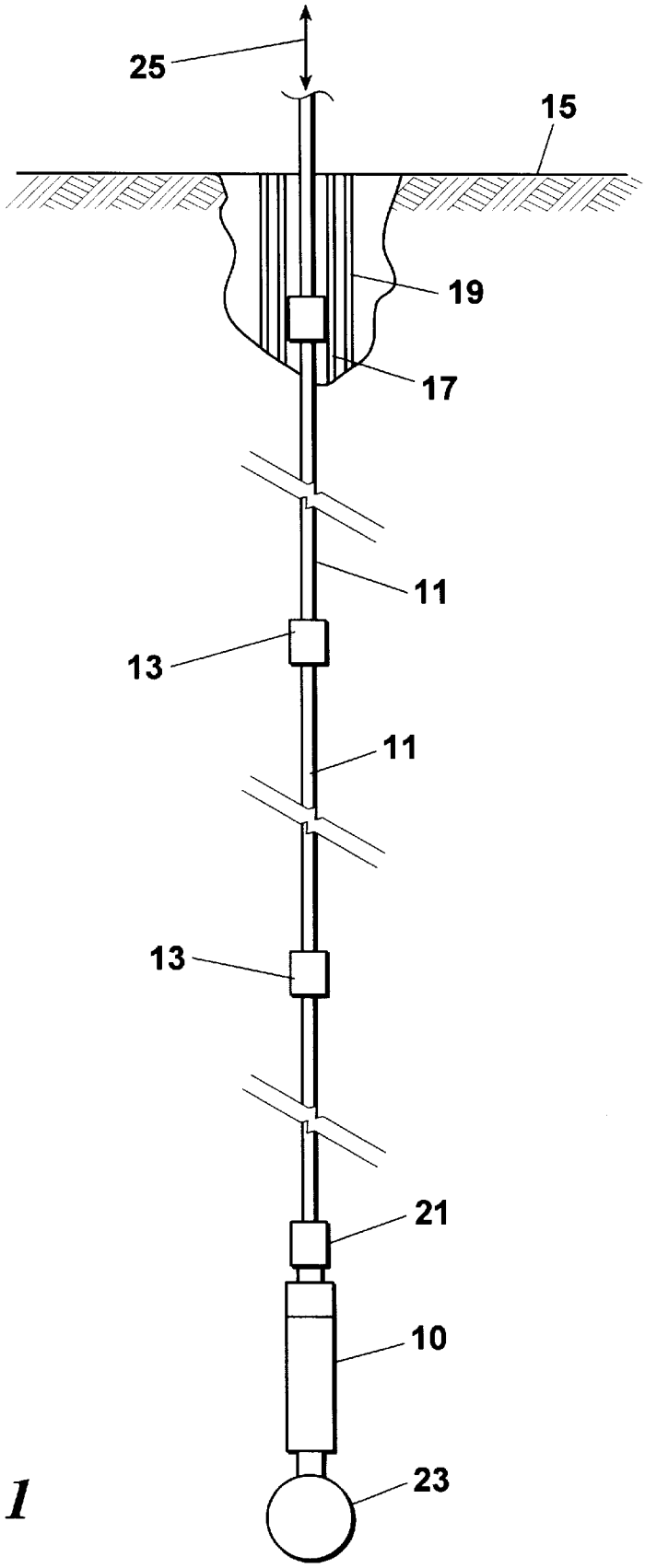
FIG. 1 is a diagrammatic elevation view illustrating the environment in which the no tap tool is used.
Figure 2:
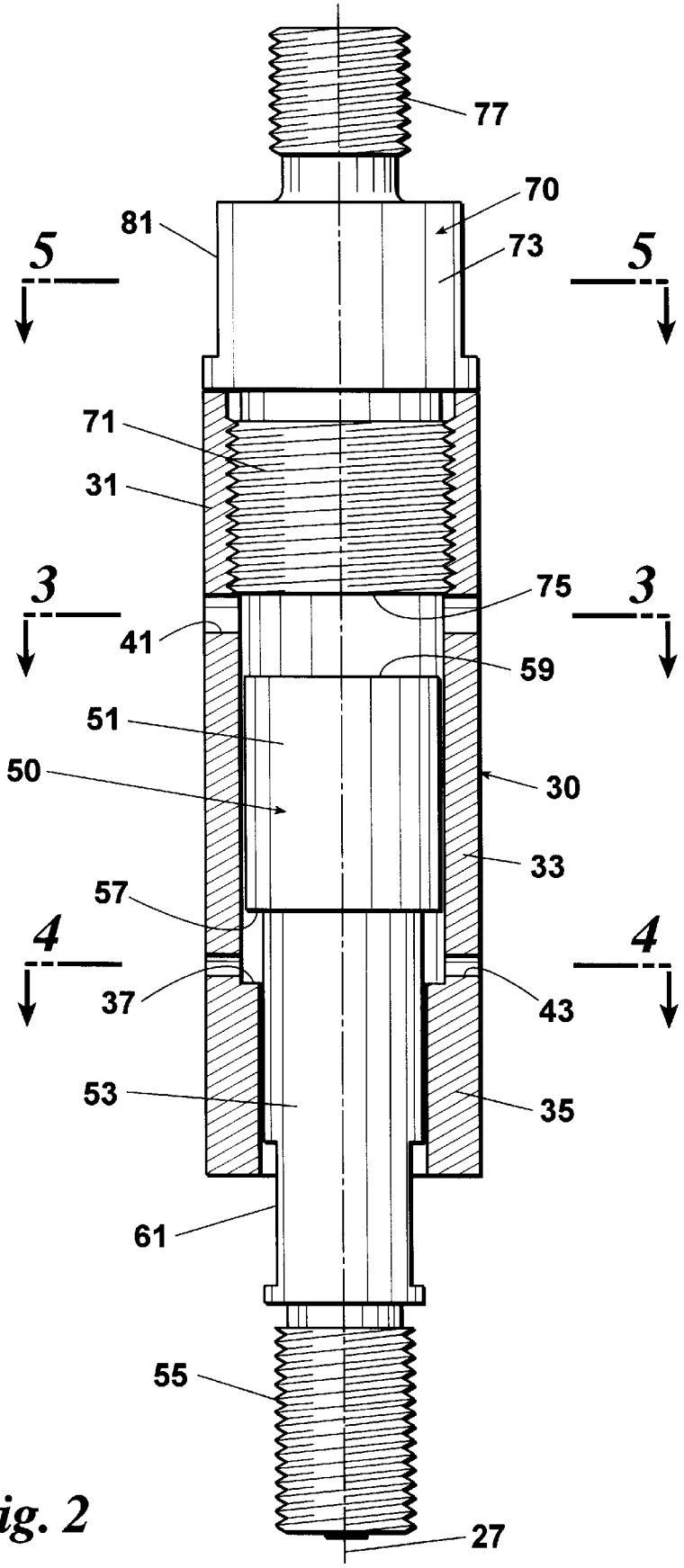
FIG. 2 is a diametric cross section of a preferred embodiment of the no-tap tool.
Figure 5:
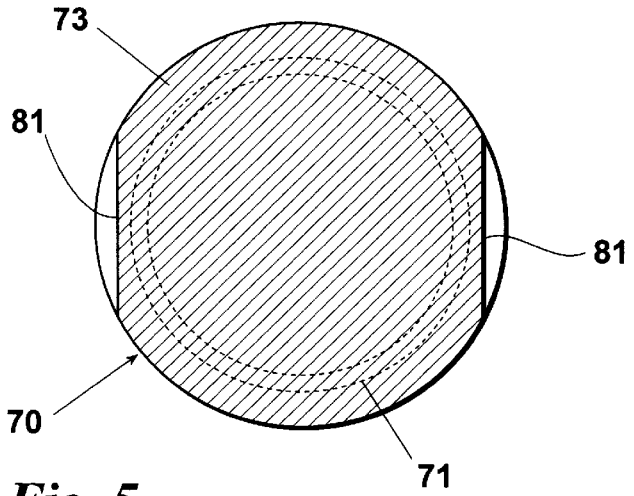
FIG. 5 is a cross-sectional view taken along the line 5—5 of FIG. 2.
Figure 3:
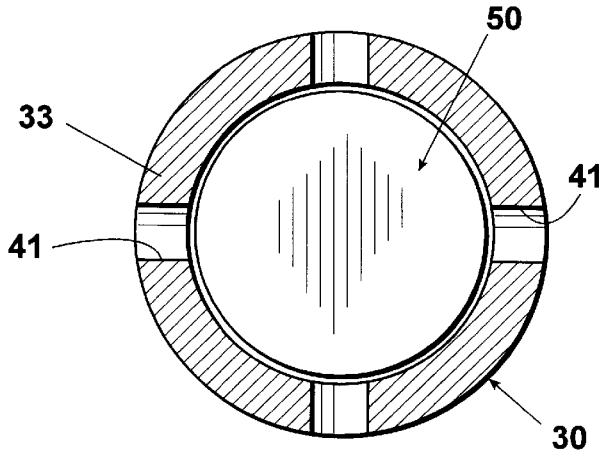
FIG. 3 is a cross-sectional view taken along the line 3—3 of FIG. 2.
Figure 4:
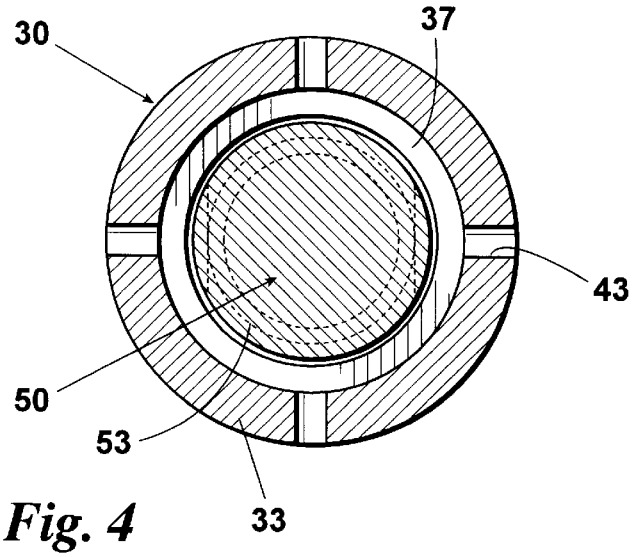
FIG. 4 is a cross-sectional view taken along the line 4—4 of FIG. 2.

Looking first at FIG. 1, the environment in which the no tap tool 10 is to be used is illustrated. A sucker rod string consisting of a number of sucker rods 11 connected by couplings 13 extends from ground level 15 within the tubing 17 in the cased well bore 19. At the lowermost sucker rod 11, a polish rod coupling 21 is used to connect the tool 10 to the pump 23. The sucker rod string is reciprocated vertically 25 by the pump operating device (not shown) located above ground level 15.

Turning to FIGS. 2 through 5, the tool 10 consists of a cylinder 30, a piston or plunger 50 and a pin 70, all concentrically aligned on a vertical longitudinal axis 27.

In the preferred embodiment shown, the cylinder 30 has an internally threaded upper portion 31, a smooth middle portion 33 and a lower portion 35. The lower portion 35 has an inner diameter less than the inner diameter of the middle portion 33 so as to define an internal annular seat 37 at the junction of the middle and lower portions 33 and 35 of the cylinder 30. At least one aperture 41 is provided through the upper side wall of the middle portion 33 of the cylinder 30, preferably substantially immediately below the top of the middle portion 33 of the cylinder 30. At least one aperture 43 is also provided through the lower side wall of the middle portion 33 of the cylinder 30, preferably substantially immediately above the internal seat 37. Preferably, four upper apertures 41 and four lower apertures 43 will be substantially equally spaced about the circumference of the cylinder 30.

The piston or plunger 50 has a smooth upper portion 51, a smooth middle portion 53 and an externally threaded lower portion 55. The outer diameter of the middle portion 53 is less than the outer diameter of the upper portion 51, thus providing a stop 57 which cooperates with the seat 37 of the cylinder 30 to limit the lowermost travel of the downstroke of the piston 50 within the cylinder 30. The length of the middle portion 53 of the piston 50 is such that the upper portion 51 of the piston 50 can reciprocate from the top to the bottom of the middle portion 33 of the cylinder 30 with the lower threaded portion 55 of the piston 50 extending below the bottom of the cylinder 30. Since the components of the cylinder 30 and the components of the piston 50 are all concentric, the piston 50 may be slidably reciprocated along the tool axis 27 and is also free to rotate within the cylinder 30 about the tool axis 27. As shown, the middle portion 53 of the piston 50 is provided with tooling flats 61.

The pin 70 has an externally threaded lower portion 71 which engages within the internal threads of the upper portion 31 of the cylinder 30. The middle portion 73 of the pin 70 has an outer diameter which is greater than the inner diameter of the upper portion 31 of the cylinder 30 so that, when the pin 70 is fully threaded into the cylinder 30, the middle portion 73 of the pin engages the upper end of the cylinder 30 and sets the horizontal lower face 75 of the pin 70 at the junction of the upper and middle portions 31 and 33 of the cylinder 30. The upper portion 77 of the pin 70 is externally threaded for engagement with a polish rod coupling at the lowermost end of the sucker rod string as shown in FIG. 1. The pin 70 closes the upper end of the cylinder 30 and the lower horizontal face 75 of the pin 70 is cooperable with the upper horizontal face 59 of the piston to limit the uppermost travel of the piston 50 within the cylinder 30. As shown, the middle portion 73 of the pin 70 is provided with tooling flats 81.

In operation, the tool 10 is mounted at the location illustrated in FIG. 1 between the lowermost sucker rod 11 and the pump 23. The stroke of the plunger in the pump 23 is set so that the plunger does not strike the pump 23 at the bottom of its stroke. However, during the reciprocation of the sucker rod string, as the cylinder 30 is reciprocated, the upper portion 51 of the piston 50 alternately strikes the lower face 75 of the pin 70 and the seat 37 in the cylinder 30, resulting in cyclical upward and downward impact on the pump plunger without impacting the pump. At the same time, the piston 50 and therefore the plunger which is attached to it, are free to rotate about the tool longitudinal axis 27, thus allowing the plunger to take the path of least resistance and resulting in minimal force being exerted on the other system components while the plunger is freed from a stuck condition.

While, in the preferred embodiment, the piston 50 extends through the open lower end of the cylinder 30, the tool 10 could be inverted and the piston 50 adapted for connection to the sucker rod string and the pin 70 adapted for connection to the pump.

Thus, it is apparent that there has been provided, in accordance with the invention, a no-tap tool that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A tool connectable between the last sucker rod of a sucker rod string and a downhole pump comprising:

a cylinder having a closed upper end externally adapted for connection to the last sucker rod of the sucker rod string, an internal annular seat proximate an open lower end thereof, at least one aperture through an upper side wall of said cylinder and at least one aperture through a lower side wall of said cylinder; and a piston reciprocally slidably and rotatively disposed within said cylinder and having a lower portion adapted for connection to the pump extending through said open end of said cylinder, said cylinder seat limiting a lowermost travel of said piston within said cylinder and said closed end of said cylinder limiting an uppermost travel of said piston within said cylinder, said at least one upper aperture venting well fluid from said cylinder as said piston reciprocates upwardly and said at least one lower aperture venting well fluid from said cylinder as said piston reciprocates downwardly.

2. A tool according to claim 1, said at least one upper aperture comprising four apertures substantially equally spaced about a circumference of said cylinder.

3. A tool according to claim 1, said at least one upper aperture being disposed substantially immediately below said closed end of said cylinder.

4. A tool according to claim 1, said at least one lower aperture comprising four apertures substantially equally spaced about a circumference of said cylinder.

5. A tool according to claim 1, said at least one lower aperture being disposed substantially immediately above said cylinder seat.

6. A tool connectable between the last sucker rod of a sucker rod string and a downhole pump comprising:

a cylinder concentric about a vertical longitudinal axis and having an internally threaded upper portion, a smooth middle portion with at least one aperture through an upper end thereof and at least one aperture through a lower end thereof and a lower portion of inner diameter less than an inner diameter of said middle portion so as to form an annular seat at a junction of said cylinder middle and lower portions;

a plunger concentric about said vertical longitudinal axis and having an externally threaded lower portion adapted to be coupled to the pump, a smooth middle portion and a smooth upper portion having a horizontal end face and an outer diameter greater than an outer diameter of said middle portion so as to form an annular stop at a junction of said plunger middle and upper portions, said plunger upper portion being reciprocally slidably and rotatively disposed within said cylinder middle portion and said stop and said seat being cooperable to limit a lowermost travel of said plunger upper portion within said cylinder; and a pin concentric about said vertical longitudinal axis and having an externally threaded lower portion with a horizontal end face engaged in said internally threaded upper portion of said cylinder, a middle portion of outer diameter greater than an inner diameter of said plunger so as to position said pin end face at a top of said cylinder middle portion when said pin lower portion is fully threaded into said cylinder upper portion and an externally threaded upper portion adapted for engagement with the last sucker rod of the sucker rod string, said pin and plunger end faces being cooperable to limit an uppermost travel of said plunger upper portion within said cylinder with said plunger lower portion extending below said cylinder lower portion, said at least one upper aperture venting well fluid from said cylinder middle portion as said plunger reciprocates upwardly and said at least one lower aperture venting well fluid from said cylinder middle portion as said plunger reciprocates downwardly.

7. A tool according to claim 6, said at least one upper aperture comprising four apertures substantially equally spaced about a circumference of said cylinder.

8. A tool according to claim 6, said at least one upper aperture being disposed substantially immediately below said closed end of said cylinder.

9. A tool according to claim 6, said at least one lower aperture comprising four apertures substantially equally spaced about a circumference of said cylinder.

10. A tool according to claim 6, said at least one lower aperture being disposed substantially immediately above said cylinder seat.

11. A tool connectable between the last sucker rod of a sucker rod string and a downhole pump comprising:

a cylinder having a closed end externally adapted for connection between the last sucker rod of the sucker rod string and the pump, an internal annular seat proximate an open end thereof, at least one aperture through a closed end side wall of said cylinder and at least one aperture through an open end side wall of said cylinder; and a piston reciprocally slidably and rotatively disposed within said cylinder and having a portion adapted for connection to the pump extending through said open end of said cylinder, said cylinder seat limiting travel of said piston within said cylinder in one direction of reciprocation of said piston and said closed end of said cylinder limiting travel of said piston within said cylinder in another direction of reciprocation of said piston, said at least one open end aperture venting well fluid from said cylinder as said piston reciprocates in said one direction and said at least one closed end aperture venting well fluid from said cylinder as said piston reciprocates in said another direction.

* * * * *